US009125457B2

(12) United States Patent
Tuma

(10) Patent No.: US 9,125,457 B2
(45) Date of Patent: Sep. 8, 2015

(54) FASTENING SYSTEM, IN PARTICULAR AS A BUTTON OR CLOSURE SUBSTITUTE

(71) Applicant: Gottlieb Binder GmbH & Co. KG, Holzgerlingen (DE)

(72) Inventor: Jan Tuma, Herrenberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 0 days.

(21) Appl. No.: 14/090,254

(22) Filed: Nov. 26, 2013

(65) Prior Publication Data

US 2014/0101901 A1 Apr. 17, 2014

(30) Foreign Application Priority Data

Dec. 6, 2012 (DE) ..... 10 2012 023 920

(51) Int. Cl.
*A44B 18/00* (2006.01)

(52) U.S. Cl.
CPC ..... *A44B 18/0003* (2013.01); *A44B 18/0073* (2013.01); *A44B 18/0088* (2013.01); *A41D 2300/326* (2013.01); *Y10T 24/2708* (2015.01); *Y10T 24/2742* (2015.01)

(58) Field of Classification Search
CPC ..... A44B 18/0003; A44B 18/0088; A44B 18/0073; A41D 2300/326; Y10T 24/2742; Y10T 24/2708
USPC ..... 24/306, 443, 446, 448, 449, 451, 452; 2/2.17, 161.4, 908, 912, 920
See application file for complete search history.

(56) References Cited

U.S. PATENT DOCUMENTS

| | | | | |
|---|---|---|---|---|
| 3,387,345 | A * | 6/1968 | Jean-Claude Savoir | 24/446 |
| 4,570,268 | A * | 2/1986 | Freeman | 2/114 |
| 5,142,743 | A * | 9/1992 | Hahn | 24/16 R |
| 5,222,258 | A * | 6/1993 | Mucci et al. | 2/114 |
| 5,231,738 | A * | 8/1993 | Higashinaka | 24/446 |
| 5,378,522 | A * | 1/1995 | Lagomarsino | 428/100 |
| 5,669,120 | A * | 9/1997 | Wessels et al. | 24/446 |
| 5,691,026 | A * | 11/1997 | Zinke et al. | 428/100 |
| 7,454,798 | B2 * | 11/2008 | Feodoroff | 2/114 |
| 2003/0150087 | A1 * | 8/2003 | Dieterich | 24/306 |
| 2005/0235462 | A1 * | 10/2005 | Takahashi et al. | 24/114.05 |
| 2009/0100648 | A1 * | 4/2009 | Naftalin et al. | 24/306 |

* cited by examiner

*Primary Examiner* — Robert J Sandy
*Assistant Examiner* — Louis Mercado
(74) *Attorney, Agent, or Firm* — Raylance, Abrams, Berdo and Goodman LLP

(57) ABSTRACT

A fastening system, in particular as a button or fastener substitute, has at least two active partners (6, 8). Each active partner (6, 8) has at least two different types of hook-and-loop fastener elements that are detachably connected to corresponding, complementary hook-and-loop fastener elements of the other active partner (6, 8).

17 Claims, 3 Drawing Sheets

FASTENING SYSTEM, IN PARTICULAR AS A BUTTON OR CLOSURE SUBSTITUTE

FIELD OF THE INVENTION

The invention relates to a fastening system, in particular as a button or fastener substitute, having at least two active partners. One partner, when in use, preferably assumes the function of a button or fastener part. The other partner assumes the function of a respective buttonhole or additional fastener part.

BACKGROUND OF THE INVENTION

With long rows of buttons, such as those often provided on clothing items in particular, buttoning operations become relatively time consuming. A certain amount of manual dexterity is required in particular for buttoning-up operations.

SUMMARY OF THE INVENTION

An object of the invention is to provide an improved fastening system, in particular a button or fastener substitute offering a maximum amount of convenience for a user.

According to the invention, this object is basically achieved by a fastening system having, as one important feature of the invention, each active partner including at least two different types of hook-and-loop fastener elements that can be mated and detachably connected to corresponding hook-and-loop fastener elements of the other active partner. Due to the fact that at least two different types of hook-and-loop fastener elements are provided on each of the active partners embodying the buttonhole function or the closing part function and the function of the respective button and/or additional fastening part, i.e., for example, mushroom head-shaped hook elements, hooks, loops or loop meshes formed by a nonwoven or velour, the advantages of simple and convenient manipulability of hook-and-loop fasteners can be utilized advantageously, preferably also as a button or fastener substitute.

The hook-and-loop fastener elements are preferably provided on a backing in the form of a band defining a longitudinal axis, in particular in the form of strips along the longitudinal axis of the band.

The arrangement may particularly advantageously be such that hook-and-loop fastener elements of one type are arranged on a strip extending centrally on the backing and hook-and-loop fastener elements of at least one other type are arranged in a strip extending on each side along the central strip.

In advantageous exemplary embodiments, the centrally arranged strip comes to an end at a distance from the ends of the band of the backing, and the lateral strips merge with one another between the ends of the central strip and the ends of the band. The outer strips therefore form a complete border of a central strip with hook-and-loop fastener elements of the central strip and of the outer strips being different.

Hook-and-loop fastener elements of at least one type are particularly advantageously formed from the material of the backing.

These fastener elements may be in particular micro-hook-and-loop fastener elements having mushroom head shapes, formed on a backing made of plastic. Such hook-and-loop fastener elements may be formed by micro-extrusion of polypropylene or polyamide.

In addition, at least one strip of hook-and-loop fastener elements of a textile material such as a nonwoven, preferably velour, may be applied particularly advantageously to a backing made of plastic.

In the case of a backing made of a textile material, a plastic film that forms at least one strip having hook-and-loop fastener elements formed from the film material, as well as a strip of textile material, may be provided in an advantageous manner, this material forming hook-and-loop fastener elements of the other type, respectively. The hook-and-loop fastener elements of the latter type may be formed from the textile material itself in the form of loops, for example.

In a particularly advantageous embodiment, a strip, preferably of a self-adhesive velour, is arranged in the central region between strips formed from a plastic film and having hook-and-loop fastener elements of another type.

For application to a respective structure, in particular to a clothing item, an adhesive layer, preferably of a heat-activatable adhesive, may advantageously be provided on the underside of the backing. In this way, the backing may be applied in a particularly simple and economical manner, for example, by a type of iron-on application.

Alternatively, a textile fabric forming outer hook-and-loop fastener elements may be provided on the underside of the backing. In this way, a hook-and-loop fastener, which forms an adhesive connection with hook-and-loop fastener elements provided on the structure, for example, the clothing. Its adhesive power for applying the backing to the structure is designed to be stronger than that of the active partners implementing the button and buttonhole functions.

A pull-away film on the adhesive layer may advantageously be provided on the underside of the backing. The pull-away film facilitates simple and secure handling prior to the actual use.

To achieve color effects, for example, on clothing items for fashion reasons, different types of hook-and-loop fastener elements may be rendered identifiable by different colors of the respective strip.

Other objects, advantages and salient features of the invention will become apparent from the following detailed description, which, taken in conjunction with the annexed drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
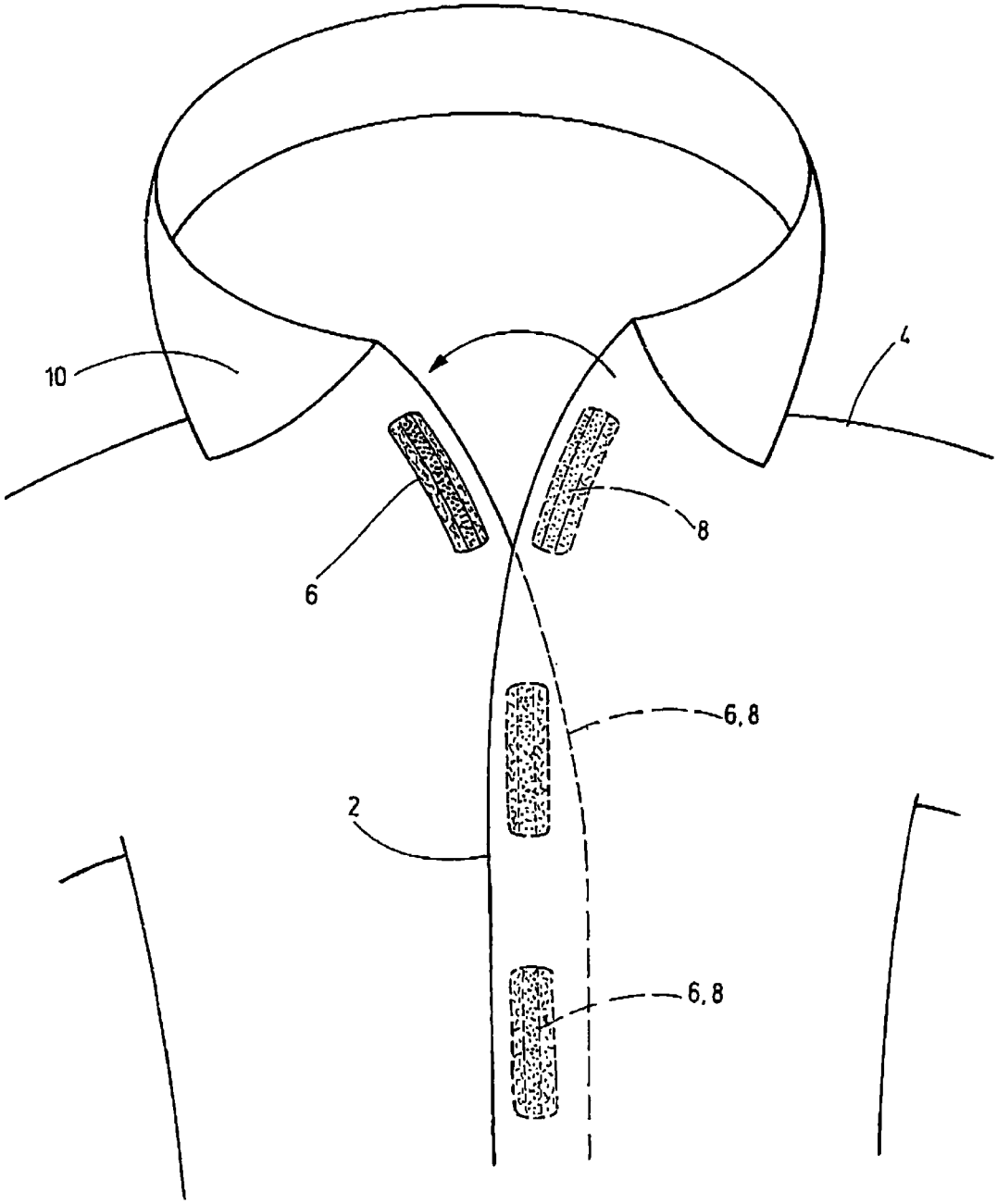
FIG. 1 is a schematic, highly simplified front elevational view of a part of a shirt-like clothing item in the area of the button strip, provided as a button substitute with an exemplary embodiment of the fastening system according to the invention.

The invention is explained in greater detail below on the basis of an example in which the fastening system is provided as a button substitute on a button strip 2 of a shirt-like clothing item 4. In FIG. 1, the active partners fulfilling the function of a button are labeled as 6, and the active partners fulfilling the function of a corresponding buttonhole are labeled as 8. In FIG. 1, only three pairs of active partners 6, 8 are visible on the button strip 2. The top pair in the figure is not shown as working together because the button strip 2 is open in the area adjacent to the collar 10. Further details of the design of the active partners 6, 8 according to the exemplary embodiments of the invention are illustrated in FIGS. 2 through 7.

Figure 2:
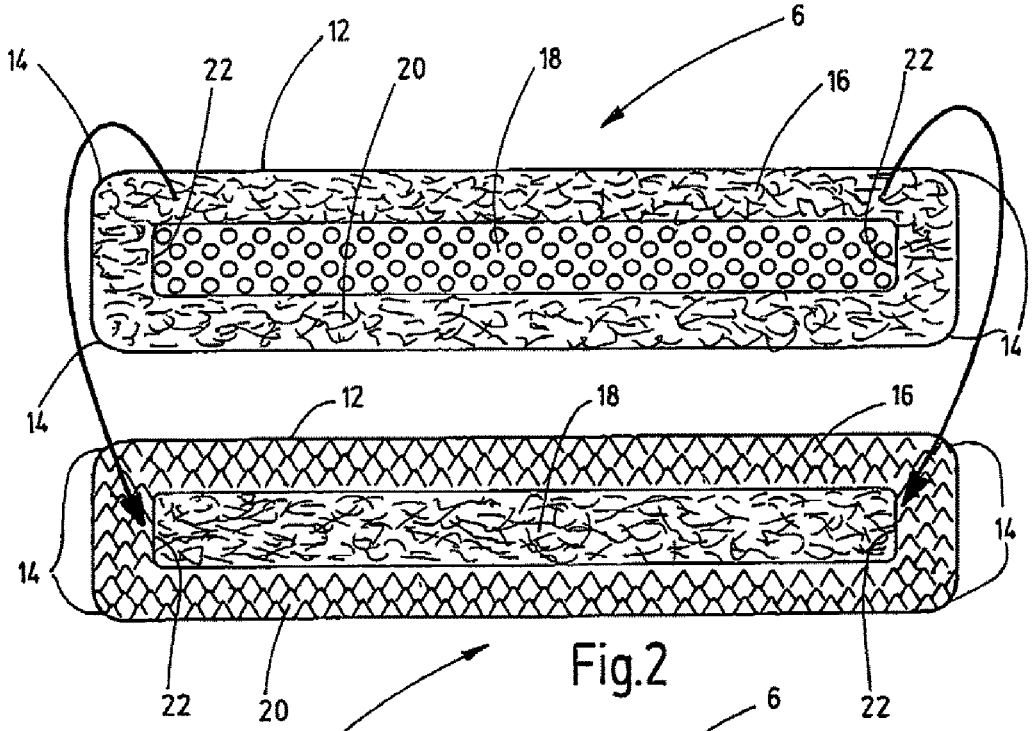
FIG. 2 is a highly schematic and simplified top view of a pair of active partners of a fastening system according to a first exemplary embodiment of the invention, wherein the hook-and-loop fastener elements on a backing are not drawn to scale but instead are greatly enlarged for the purpose of illustration.

FIG. 2 shows a pair of active partners 6, 8 according to a first exemplary embodiment, in which the two partners 6, 8 each have a backing 12 of the same shape and dimensions. As this shows, the backing 12 is in the form of a band extending with a rectangular outline along a longitudinal axis running horizontally in the diagram in this figure. The corner areas 14 are each rounded. Hook-and-loop fastener elements are provided on the top side of the backing 12, as visible in the drawing, in strips 16, 18 and 20 that extend parallel to one another along the longitudinal axis. In the example in FIG. 2 as well as in the examples in FIGS. 3 and 4, discussed in greater detail below, the centrally positioned strip 18 ends at a distance from the ends of the backing 12. The outer strips 16 and 20 merge with one another in connection to the ends 22 of the central strip 18, so that no region of the top side of the backing 12 is free of the strips 16, 18, 20 with their respective hook-and-loop fastener elements.

In the example in FIG. 2, loops or loop meshes are provided as the hook-and-loop fastener elements of the active partners 6 of the outer strips 16, 20, i.e., the outer strips 16, 20 are formed by a textile fabric that constitutes the loop structure or loop mesh structure, i.e., a nonwoven or velour fabric. The central strip 18 has mushroom head-shaped hook-and-loop fastener elements, in particular in the form of micro-hook-and-loop fastener elements made of plastic. The other active partner 8 of the pair shown in FIG. 2 is also provided with hook-and-loop fastener elements of different types, namely with the hook type of hook-and-loop fastener elements for the outer strips 16, 20 and the loop type or the loop mesh type of hook-and-loop fastener elements corresponding to the central strip 18 of the active partner 6 along the sides of the central strip 18. Each of the partners 6, 8 in FIG. 2 has a backing 12 made of plastic, such as polypropylene or polyamide, wherein the hook-and-loop fastener elements of the central strip 18 are formed from the backing material itself in the case of the active partner 6, for example, being formed by micro-extrusion. The outer strips 16 of the active partner 6 of FIG. 2 are formed from a nonwoven such as a velour fabric, for example, a self-adhesive velour, which is connected to the plastic backing 12. The other partner 8 in FIG. 2 has a hook structure formed from the backing material 12 in the outer strips 16, 20, whereas the central strip 18 is formed by a self-adhesive velour.

Figure 3:
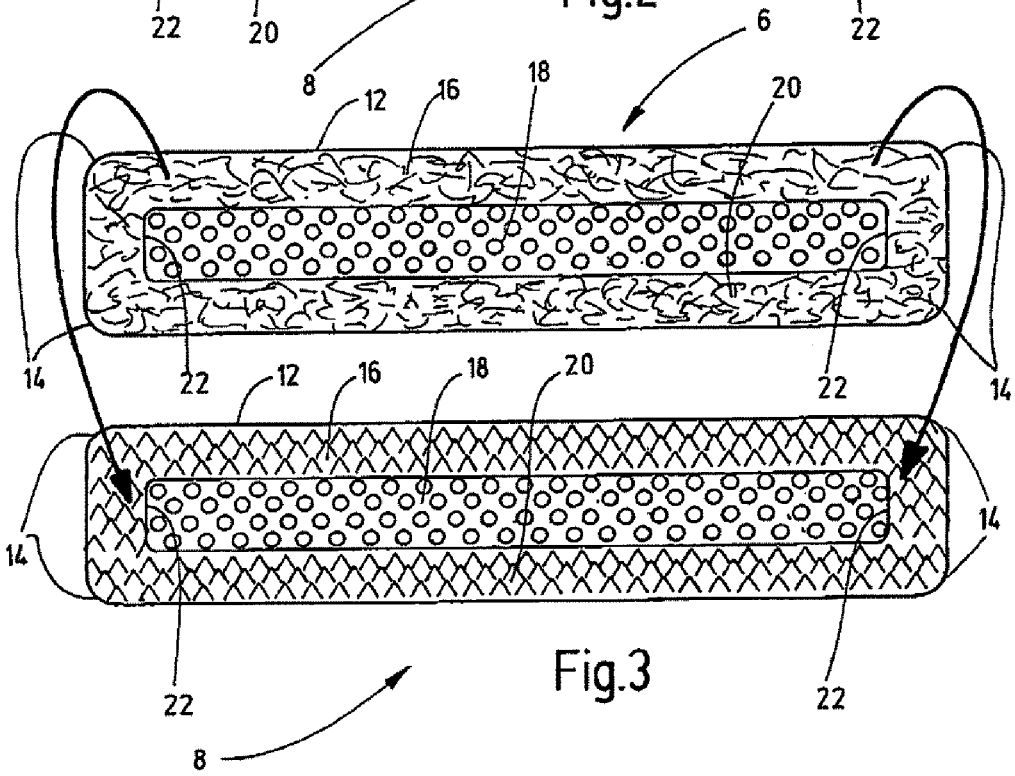
FIG. 3 is a highly schematic and simplified top view of a pair of active partners of a fastening system according to a second exemplary embodiment of the invention.

In the additional example of FIG. 3, the active partner 6 corresponds to that of FIG. 2. In the other active partner 8, the central strip 18 corresponds to that of the active partner 6, so that mushroom-head shapes become engaged with mushroom-head shapes when they work together, thereby forming a so-called hermaphrodite fastener. The outer strips 16 and 20 of the active partner 8 are formed as hook elements of the hook-and-loop fastener elements of another type. The outer strips 16, 20 may then be formed from the backing material 12, or the central strip 18 may be formed from the backing, for example, by micro-extrusion, wherein strips having another type of hook-and-loop fastener elements in the form of micro-extruded plastic films having a three-dimensional structure of the hook-and-loop fastener elements may be applied to the backing 12.

Such thin micro-extruded films having a three-dimensional structure, for example, in the form of Mikroplast® film distributed by the applicant may also be applied to a textile backing such as velour to form one of the strips 16, 18, 20, wherein the velour of the backing itself forms the hook-and-loop fastener elements of the other type.

Figure 4:
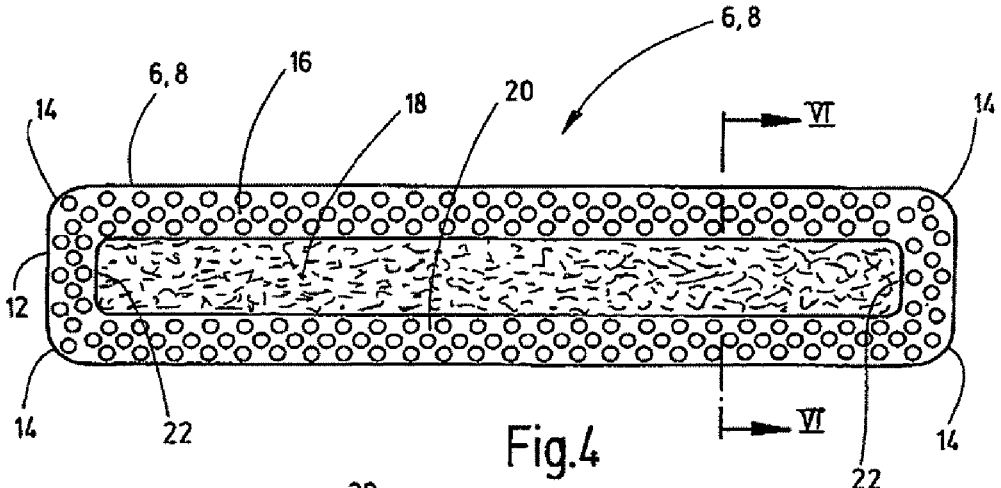
FIG. 4 is a highly schematic and simplified top view of a single active partner of a fastening system according to a third exemplary embodiment of the invention.

FIG. 4 shows a single active partner 6 or 8 in which in contrast with the diagrams of FIGS. 2 and 3, the central strip 18 is a self-adhesive velour applied to the backing 12 made of plastic. The outer strips 16, 20 have mushroom-head shapes made of the material of the backing 12 as fastener elements.

Figure 5:
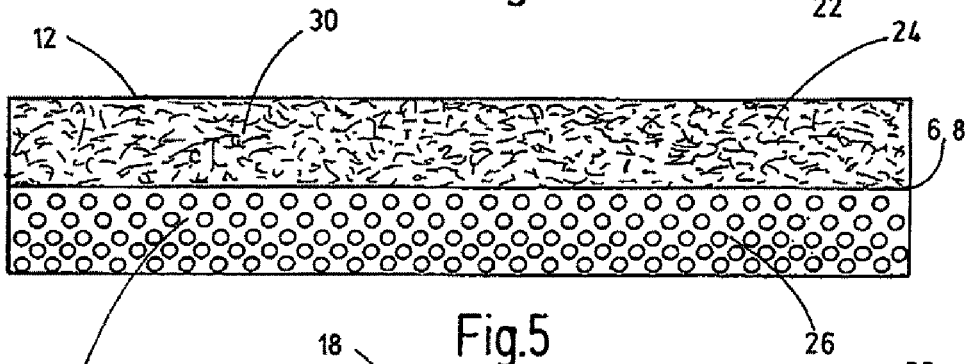
FIG. 5 is a highly simplified and schematic top view of a single active partner of a fastening system according to a fourth exemplary embodiment of the invention.

FIG. 5 shows a band section of a backing 12, in which only two strips 24 and 26 having different hook-and-loop fastener elements are provided in contrast with the other examples shown here. Each strip 24, 26 forms one half of a band. Such a backing 12, furnished with two strips 24, 26, may be provided as an active partner 6 or 8 of corresponding exemplary embodiments.

Figure 6:
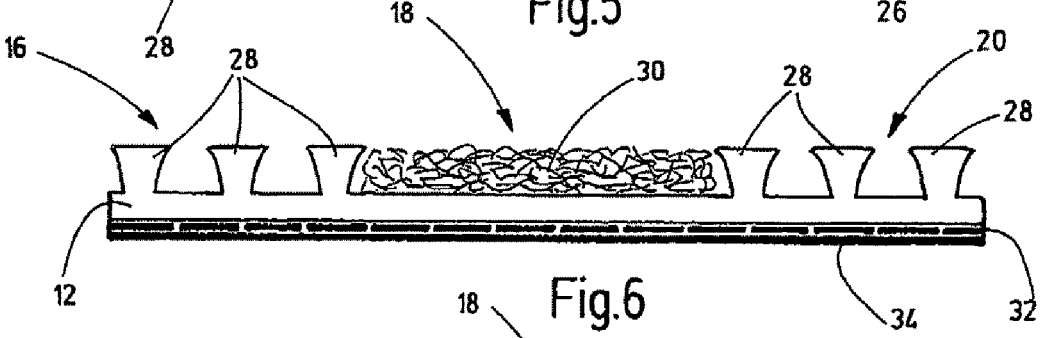
FIG. 6 is an enlarged and highly schematic and simplified side elevational view in section taken along line VI-VI in FIG. 4.

FIG. 6 shows a highly simplified, schematic sectional diagram of the active partner 6, 8 according to sectional line VI-VI of FIG. 4. As this shows, mushroom-head shapes 28 are formed from the plastic material of the backing 12 to function as the outer strips 16 and 20. The central strip 18 of a self-adhesive velour 30 is attached to the backing 12. An adhesive layer 32 of a heat-activatable material is provided on the underside of the backing 12 to secure the backing 12 to a respective structure, for example, an item of clothing 4. The outside of the adhesive layer is covered with a pull-away film 34. Such a backing 12 may be secured by ironing it onto a suitable item of clothing 4 and shown as an example in FIG. 4.

Figure 7:
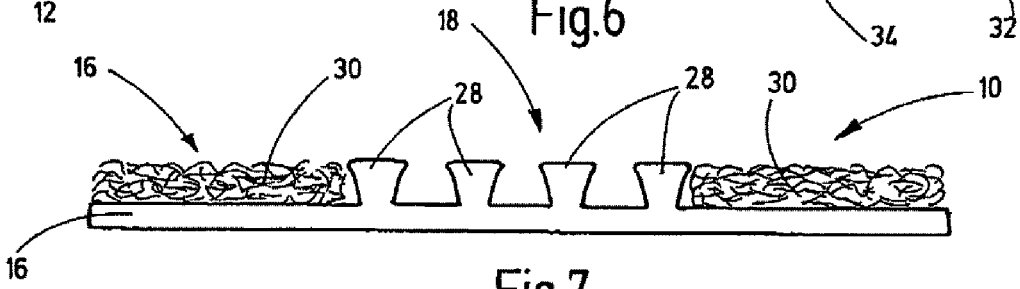
FIG. 7 is an enlarged and highly schematic and simplified side elevational view in section diagram of a single active partner according to another exemplary embodiment of the invention.

FIG. 7 shows another modification, in which the central strip 18 again has mushroom-head shapes 28 formed from the plastic material of the backing 12, while the outer strips 16 and 20 are formed by a self-adhesive velour 30.

To achieve color matching or a contrast effect when used on fashionable clothing items 4, the individual strips 16, 18, 20, 24, 26 may have different colors.

The fastening system according to the invention, with the respective complementary, interacting active partners, each having at least two different types of hook-and-loop fastener elements, may preferably be used as a button or fastener substitute. However, other applications are also possible here, for example, as the fastener parts of baby diapers or shoes as well as any type of packaging. Since each active partner has at least two different types of hook-and-loop fastener elements, which can interact with the complementary hook-and-loop fastener elements on the other active partner, a very large "target zone" is created, making it possible to close the aforementioned fastening system in an accurate and functionally reliable manner, but also to open it again.

This fastening system can be used reliably under conditions of poor visibility in particular, but also in the event of a possible physical impairment of the user, because of the large "target zone" or "hit zone," in which case a colored background of at least parts of the respective active partner further increases user reliability. At this point, it also need not be emphasized further that, in the case of an attractive visual design of the fastening system in particular, this readily meets elevated design requirements, such as those regularly encountered in the clothing industry.

In particular also on clothing items that tend to become soiled, such as footwear, the corresponding active partner with its differently designed target zones or hit zones can ensure a long-lasting functional reliability, even when certain regions of the active partner with the respective hook-and-loop fastener element have a greater tendency to become soiled than other regions. For example, a loop or velour material usually tends to become permanently soiled to a greater extent than hook or mushroom head-type fastener elements functioning as the hook-and-loop active partner. The fastening system according to the invention described here may also be used in other technical fields, including medical technology, based on the existing advantages, such as greater functional reliability, better and higher hook-and-loop fastener forces, visually attractive design, etc.

While various embodiments have been chosen to illustrate the invention, it will be understood by those skilled in the art that various changes and modifications can be made therein without departing from the scope of the invention as defined in the appended claims.

What is claimed is:

1. A fastening system, comprising:

first and second active partners, each said active partner having a backing in a form of a band with opposite ends and opposite sides;

a central strip of hook-and-loop fastener elements of a first type extending centrally on each of said bands of said first and second active partners, each said central strip ending at ends thereof located at a distance from said ends of the respective band, said hook-and-loop fastener elements of said central strips on said first and second active partners being complementary and being matable to form a first detachable connection of said first and second active partners; and side strips of hook-and-loop fastener elements of a second type extending along said sides of each of said bands and along sides of the respective central strip and merging with one another between said ends of the respective central strip and said ends of the respective band, said first and second types on each said active partner being different, said hook-and-loop fastener elements of said side strips on said first and second active partners being complementary and matable to form a second detachable connection of said first and second active partners.

2. The fastening system according to claim 1 wherein said first and second active partners are operable as a button and buttonhole, respectively, on an article of clothing.

3. The fastening system according to claim 1 wherein each said band defines a longitudinal axis, said strips extending along said longitudinal axis of said bands.

4. The fastening system according to claim 1 wherein said hook-and-loop fastener elements of said first type are formed of a material of the respective backing.

5. The fastening system according to claim 4 wherein said hook-and-loop fastener elements of said first type comprise micro-hook-and-loop fastener elements formed on said backings, said backing being made of plastic.

6. The fastening system according to claim 5 wherein said micro-hook-and-loop fastener elements have mushroom-head shapes.

7. The fastening system according to claim 5 wherein said micro-hook-and-loop fastener elements of said first type are formed by micro-extrusion from at least one of polypropylene or polyamide.

8. The fastening system according to claim 1 wherein at least one strip of said hook-and-loop fastener elements comprises textile material attached to one of said backings, said one of said backings being made of plastic.

9. The fastening system according to claim 8 wherein said textile material comprises a nonwoven.

10. The fastening system according to claim 9 wherein said nonwoven comprises a velour.

11. The fastening system according to claim 1 wherein at least one of said strips of each said active partners comprises a plastic film with the respective hook-and-loop fastener elements of said first type formed therefrom;

at least one other of said strips of each said active partners comprises textile material provided on said backing thereof forming said hook-and-loop fastener elements of said second type.

12. The fastening system according to claim 1 wherein said central strip on said first active partner comprises a self-adhesive velour; and each said side strip on said first active partner is formed of a plastic film having said hook-and-loop fastener elements of said second type.

13. The fastening system according to claim 1 wherein an adhesive layer is on an underside of each said backing.

14. The fastening system according to claim 13 wherein said adhesive layer comprises heat-activatable adhesive.

15. The fastening system according to claim 13 wherein a pull-away film is on each said adhesive layer.

16. The fastening system according to claim 1 wherein a textile fabric having outer hook-and-loop fastener elements is on an underside of each said backing.

17. The fastening system according to claim 1 wherein said hook-and-loop fastener elements of said first and second types are identified by different colors of the respective strips.

* * * * *